US009257009B2

(12) United States Patent
Ly

(10) Patent No.: US 9,257,009 B2
(45) Date of Patent: Feb. 9, 2016

(54) GAMING SYSTEM, JACKPOT CONTROLLER, AND A JACKPOT TRIGGERING METHOD

(75) Inventor: Sen Van Ly, Lidcombe (AU)

(73) Assignee: Aristocrat Technologies Australia Pty Limited (AU)

( * ) Notice: Subject to any disclaimer, the term of this patent is extended or adjusted under 35 U.S.C. 154(b) by 815 days.

(21) Appl. No.: 13/454,742

(22) Filed: Apr. 24, 2012

(65) Prior Publication Data

US 2012/0208629 A1 Aug. 16, 2012

Related U.S. Application Data

(63) Continuation of application No. 12/328,554, filed on Dec. 4, 2008, now Pat. No. 8,182,329.

(30) Foreign Application Priority Data

Dec. 5, 2007 (AU) ..... 2007906647

(51) Int. Cl.
*G07F 17/00* (2006.01)
*G07F 17/32* (2006.01)

(52) U.S. Cl.
CPC ..... *G07F 17/3258* (2013.01)

(58) Field of Classification Search
CPC ..... G07F 17/3258
USPC ..... 463/16, 17, 26, 42
See application file for complete search history.

(56) References Cited

U.S. PATENT DOCUMENTS

| | | | | |
|---|---|---|---|---|
| 6,592,458 | B1 | 7/2003 | Ho | |
| 2006/0252516 | A1 | 11/2006 | Walker et al. | |
| 2006/0287077 | A1 | 12/2006 | Grav et al. | |
| 2007/0010310 | A1 | 1/2007 | Goossens | |
| 2007/0111781 | A1 | 5/2007 | Moshal | |
| 2007/0111785 | A1 | 5/2007 | Scott | |
| 2007/0117607 | A1 | 5/2007 | Scott | |
| 2007/0149268 | A1 | 6/2007 | Gauselmann | |
| 2007/0167238 | A1* | 7/2007 | Gatto | G07F 17/32 463/42 |
| 2007/0259711 | A1* | 11/2007 | Thomas | G07F 17/3258 463/22 |

FOREIGN PATENT DOCUMENTS

| | | |
|---|---|---|
| CA | 2514156 | 1/2007 |
| CA | 2559412 | 3/2007 |
| CA | 2571434 | 6/2007 |
| JP | 2007044561 | 2/2007 |
| JP | 2007054277 | 3/2007 |
| JP | 2007068566 | 3/2007 |
| JP | 2007068704 | 3/2007 |
| JP | 2007082571 | 4/2007 |
| JP | 2007111562 | 5/2007 |
| NZ | 544852 | 6/2007 |

(Continued)

*Primary Examiner* — Reginald Renwick
(74) *Attorney, Agent, or Firm* — McAndrews, Held & Malloy, Ltd.

(57) ABSTRACT

A jackpot triggering method comprising: determining a jackpot trigger value from a current value of at least one jackpot trigger parameter; generating a submission value in response to receipt of a contribution associated with a gaming device participating in the jackpot, by using a value of at least one contribution parameter associated with the contribution as a seed value to randomly generate the submission value; and making a jackpot award if the submission value corresponds to the jackpot trigger value.

24 Claims, 5 Drawing Sheets

(56) References Cited

FOREIGN PATENT DOCUMENTS

| | | |
|---|---|---|
| WO | 2004064959 | 8/2004 |
| WO | 2005024592 | 3/2005 |
| WO | 2007084845 | 7/2007 |

* cited by examiner

GAMING SYSTEM, JACKPOT CONTROLLER, AND A JACKPOT TRIGGERING METHOD

RELATED APPLICATIONS

This application claims priority to, and is a continuation of, co-pending U.S. application Ser. No. 12/328,554, having a filing date of Dec. 4, 2008, which is incorporated herein by reference, and which claims priority to Australian Patent Application No. 2007906647, having a filing date of Dec. 5, 2007, which is also incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates to a gaming system, a jackpot controller, and a jackpot triggering method.

Many venues employ jackpot controllers for awarding jackpots to one of or more of a plurality of gaming machines participating in the jackpot. Typically, a portion of turnover on each gaming machine is forwarded to a jackpot controller as a contribution. That is, part of each wager goes towards the jackpot. The technique can be extended to a so called wide area jackpot where gaming machines from a number of different venues contribute to a single jackpot pool.

One common way of awarding a jackpot is a so called mystery jackpot where a trigger value, generally in a prize range, is randomly selected and stored by the jackpot controller. The jackpot controller determines to award the jackpot prized when the contributions cause the value of the jackpot pool to reach the trigger value.

A problem with this sort of jackpot is that while such jackpots are generally randomly determined, the range of jackpot prizes can become known and can affect play. For example, play of gaming machines may drop off just after a jackpot is awarded because players perceive the chance of winning a jackpot is diminished shortly after a previous jackpot is awarded. Similarly, play may increase as a progress jackpot reaches a value near a known upper limit.

There is a need for an alternative technique for determining to award a jackpot to a player.

BRIEF SUMMARY OF THE INVENTION

In a first aspect there is provided a jackpot triggering method comprising:

determining a jackpot trigger value from a current value of at least one jackpot trigger parameter;

generating a submission value in response to receipt of a contribution associated with a gaming device participating in the jackpot, by using a value of at least one contribution parameter associated with the contribution as a seed value to randomly generate the submission value; and making a jackpot award if the submission value corresponds to the jackpot trigger value.

In an embodiment, there are a defined set of values of the jackpot trigger parameter and determining the jackpot value comprises mapping the current value to one of the defined set of values, and the submission values may only take values corresponding to the defined set of values.

In an embodiment, the number of values in the set of values corresponds to a desired hit rate of the jackpot.

In an embodiment, the at least one jackpot trigger parameter is selected from the group including:

current time;

current pool value; and number of contributions made.

In an embodiment, the at least one contribution parameter is selected from the group including:

arrival time of the contribution;

number of games played on a gaming device associated with the contribution;

turnover on a gaming device associated with the contribution; and total win on a gaming device associated with the contribution.

In an embodiment, the jackpot trigger value is determined from at least two parameters.

In an embodiment, the jackpot trigger parameter is at least one parameter associated with a jackpot controller.

In an embodiment, the submission value is determined from at least two parameters associated with the contribution.

In a second aspect there is provided a jackpot controller arranged to:

determine a jackpot trigger value from a current value of at least jackpot trigger parameter;

generate a submission value in response to receipt of a contribution associated with a gaming device participating in the jackpot, by using a value of at least one contribution parameter associated with the contribution as a seed value to randomly generate the submission value; and make a jackpot award if the submission value corresponds to the jackpot trigger value.

In an embodiment, the jackpot controller comprises a random number generator arranged to receive the value of the contribution parameter and generate the submission value.

In an embodiment, the jackpot controller comprises a contribution processor arranged to process the contribution to determine the value of the at least one contribution parameter.

In an embodiment, there are a defined set of values of the jackpot trigger parameter and the jackpot controller is arranged to determine the jackpot value by mapping the current value to one of the defined set of values, and wherein the submission values may only take values corresponding to the defined set of values.

In an embodiment, the number of values in the set of values corresponds to a desired hit rate of the jackpot.

In an embodiment, the at least one jackpot trigger parameter is selected from the group including:

current time;

current pool value; and number of contributions made.

In an embodiment, the at least one contribution parameter is selected from the group including:

arrival time of the contribution;

number of games played on a gaming device associated with the contribution;

turnover on a gaming device associated with the contribution; and total win on a gaming device associated with the contribution.

In an embodiment, the jackpot controller is arranged to determine the jackpot trigger value from at least two parameters.

In an embodiment, the jackpot trigger parameter is at least one parameter associated with a jackpot controller.

In an embodiment, the submission value is determined from at least two parameters associated with the contribution.

In an embodiment, the jackpot controller is implemented, at least in part, by a processor arranged to process contributions to determine whether to make a jackpot award.

In a third aspect there is provided a gaming system comprising a plurality of gaming devices which may participate in a jackpot by making jackpot contributions; and a jackpot controller arranged to:

determine a jackpot trigger value from a current value of at least jackpot trigger parameter generate a submission value in response to receipt of each contribution from each gaming device participating in the jackpot, by using a value of at least one contribution parameter associated with the contribution as a seed value to randomly generate the submission value; and make a jackpot award if the submission value corresponds to the jackpot trigger value.

In an embodiment, the jackpot controller comprises a random number generator arranged to receive the value of the contribution parameter and generate the submission value.

In an embodiment, the jackpot controller comprises a contribution processor arranged to process the contribution to determine the value of the at least one contribution parameter.

In an embodiment, there are a defined set of values of the jackpot trigger parameter and the jackpot controller is arranged to determine the jackpot value by mapping the current value to one of the defined set of values, and wherein the submission values may only take values corresponding to the defined set of values.

In an embodiment, the number of values in the set of values corresponds to a desired hit rate of the jackpot.

In an embodiment, the at least one jackpot trigger parameter is selected from the group including:

current time;

current pool value; and number of contributions made.

In an embodiment, the at least one contribution parameter is selected from the group including:

arrival time of the contribution;

number of games played on a gaming device associated with the contribution;

turnover on a gaming device associated with the contribution; and total win on a gaming device associated with the contribution.

In an embodiment, the jackpot controller is arranged to determine the jackpot trigger value from at least two parameters.

In an embodiment, the jackpot trigger parameter is at least one parameter associated with a jackpot controller.

In an embodiment, the submission value is determined from at least two parameters associated with the contribution.

In a fourth aspect, the invention provides computer program code which when executed implements the above method.

In a fifth aspect, the invention provides a computer readable medium comprising the program code.

In a sixth aspect, the invention provides a data signal comprising the program code.

In a seventh aspect, the invention extends to transmitting the program code.

BRIEF DESCRIPTION OF SEVERAL VIEWS OF THE DRAWINGS

An exemplary embodiment of the invention will be described in relation to the accompanying drawings in which.

DETAILED DESCRIPTION OF THE INVENTION

Figure 1:
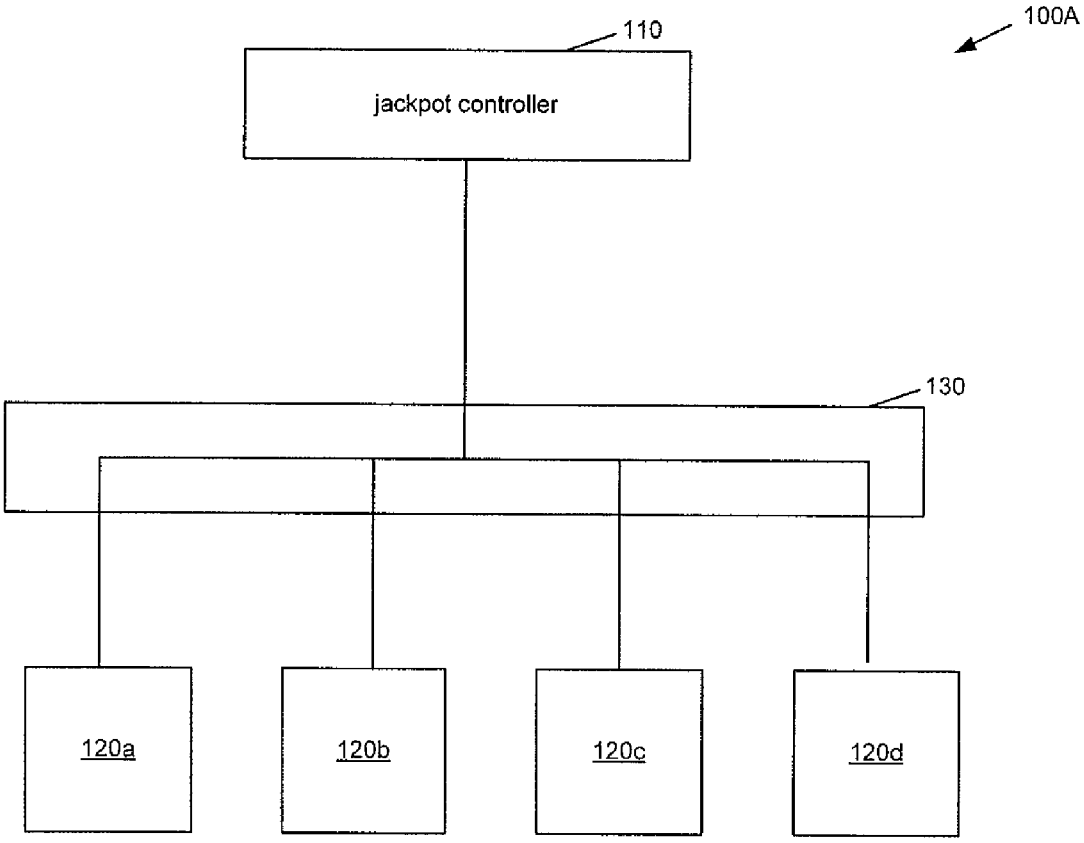
FIG. 1 is a block diagram of a gaming system.

Referring to the drawings, there is shown a gaming system arranged to implement a jackpot controller adapted to make a non-deterministic jackpot award to any one or more of a plurality of gaming devices to which it is connected which are participating in the jackpot.

General System Configuration

In the gaming system configuration 100, a jackpot controller 110 is in data communication with a plurality of gaming devices 120 over a network 130. A person skilled in the art will also appreciate that other configurations may be viable.

Gaming Devices

Herein, the term gaming device is used to refer to any device used by a player to a play a game and specifically includes stand alone gaming machines and interactive video terminals which implement games in a client/server architecture.

Figure 2:
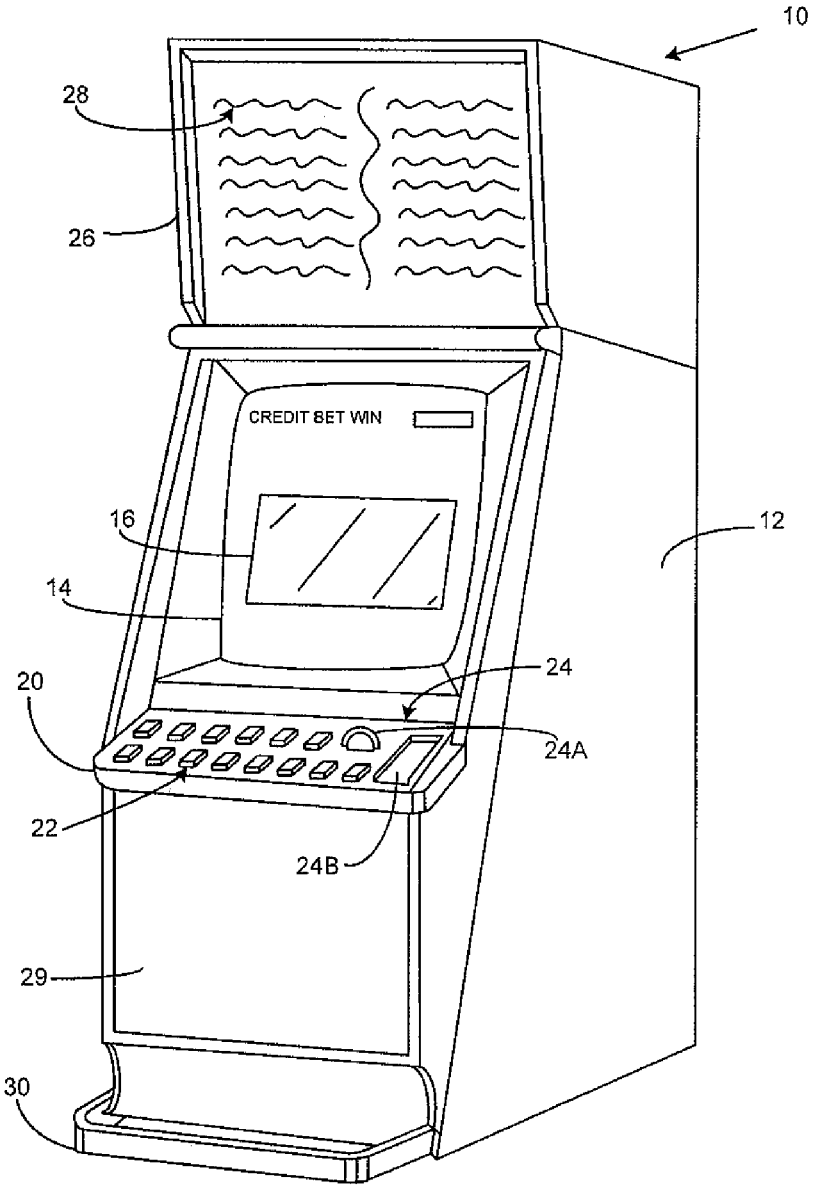
FIG. 2 is a perspective view of a gaming device in the form of a stand alone gaming machine.

A gaming device in the form of a stand alone gaming machine 10 is illustrated in FIG. 2. The gaming machine 10 includes a console 12 having a display 14 on which is displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. A player marketing module comprising a reading device may also be provided for the purpose of reading a player tracking device, for example as part of a loyalty program. The player tracking device may be in the form of a card, flash drive or any other portable storage medium capable of being read by the reading device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
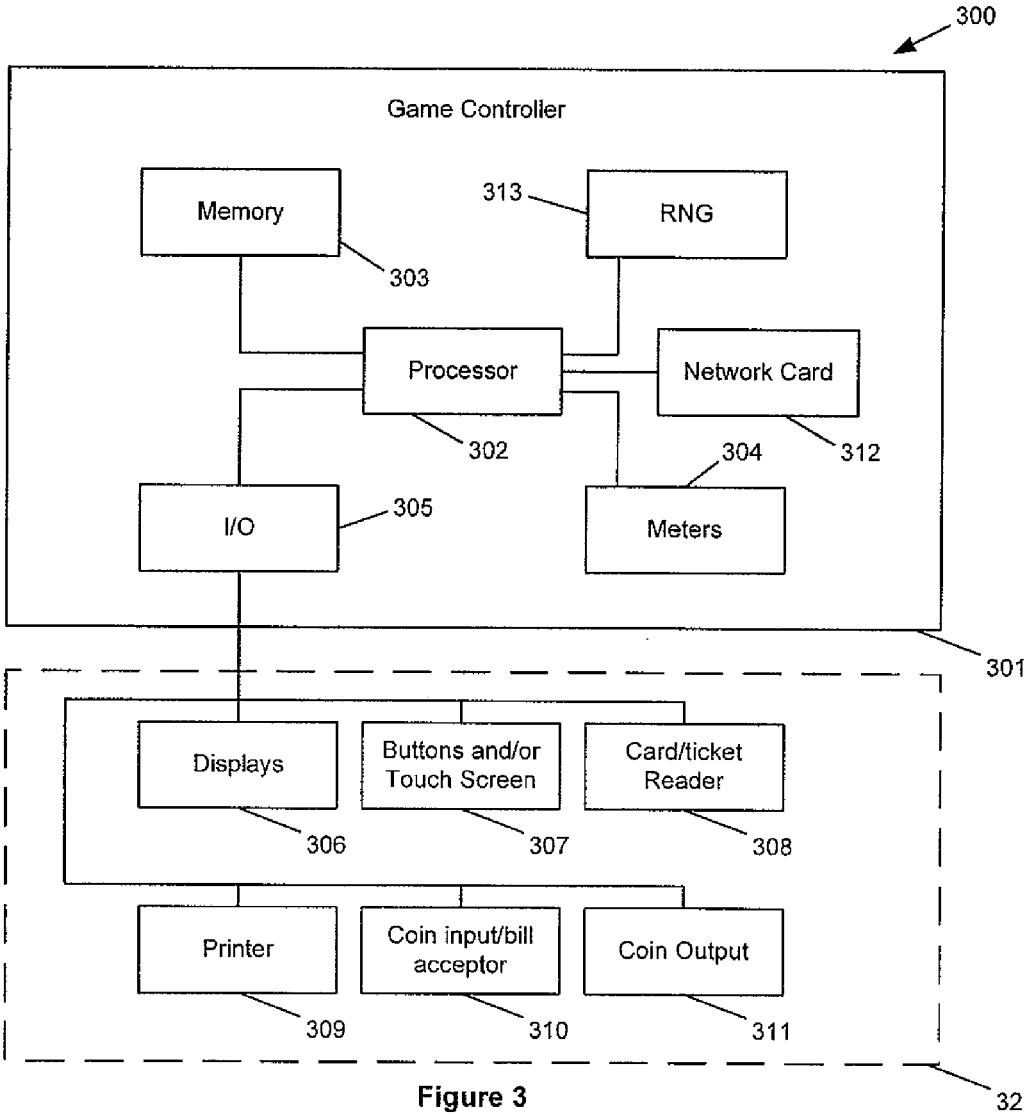
FIG. 3 is a block diagram of the functional components of a gaming machine.

FIG. 3 shows a block diagram of operative components of a typical gaming machine 300 which may be the same as or different to the gaming machine of FIG. 2.

The gaming machine 300 includes a game controller 301 having a processor 302. Instructions and data to control operation of the processor 302 are stored in a memory 303, which is in data communication with the processor 302. Typically, the gaming machine 300 will include both volatile and non-volatile memory and more than one of each type of memory, with such memories being collectively represented by the memory 303.

The gaming machine has hardware meters 304 for purposes including ensuring regulatory compliance and monitoring player credit, an input/output (I/O) interface 305 for communicating with peripheral devices of the gaming machine 300. The input/output interface 305 and/or the peripheral devices may be intelligent devices with their own memory for storing associated instructions and data for use with the input/output interface or the peripheral devices. A random number generator module 313 generates random numbers for use by the processor 302. Persons skilled in the art will appreciate that the reference to random numbers includes pseudo-random numbers.

In the example shown in FIG. 3, a player interface 320 includes peripheral devices that communicate with the game controller 301 comprise one or more displays 306, buttons and/or a touch screen 307, a card and/or ticket reader 308, a printer 309, a bill acceptor and/or coin input mechanism 310 and a coin output mechanism 311. Additional hardware may be included as part of the gaming machine 300, or hardware may be omitted as required for the specific implementation.

In addition, the gaming machine 300 may include a communications interface, for example a network card 312. The network card may, for example, send status information, accounting information or other information to a central controller, server or database and receive data or commands from the central controller, server or database.

Figure 4:
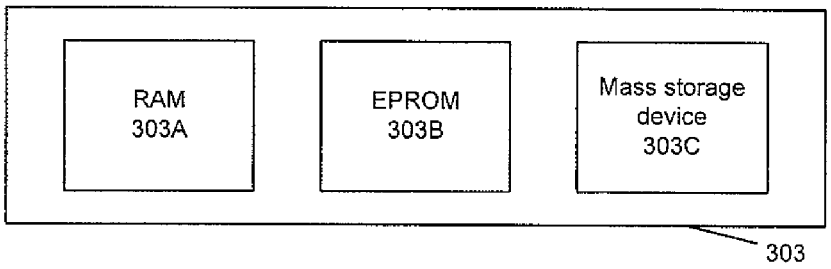
FIG. 4 is a schematic diagram of the functional components of a memory.
Figure 5:
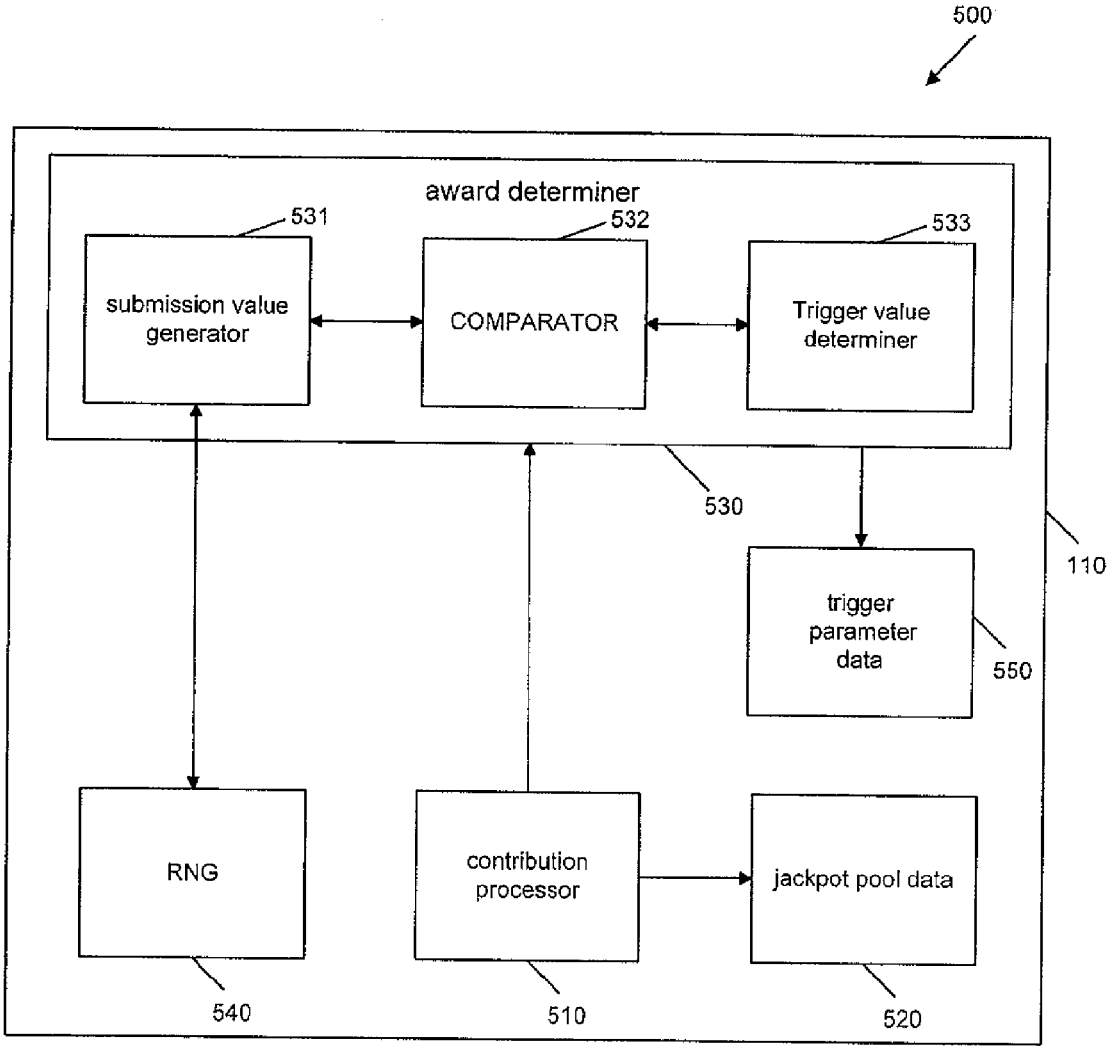
FIG. 5 is a block diagram of a jackpot controller.

FIG. 4 shows a block diagram of the main components of an exemplary memory 303. The memory 303 includes RAM 303A, EPROM 303B and a mass storage device 303C. The RAM 303A typically temporarily holds program files for execution by the processor 302 and related data. The EPROM 303B may be a boot ROM device and/or may contain some system or game related code. The mass storage device 303C is typically used to store game programs, the integrity of which may be verified and/or authenticated by the processor 302 using protected code from the EPROM 303B or elsewhere.

It is also possible for the operative components of the gaming machine 300 to be distributed, for example input/output devices 306,307,308,309,310,311 to be provided remotely from the game controller 301.

A gaming device as indicated above may also take the form of a client/server architecture where a portion of the game is executed on the client and a portion of the game is executed on the server. In such embodiments, the client typically takes the form of an interactive video terminal which has a similar outward appearance to the gaming machine described above. A person skilled in the art will appreciate that the type of gaming device that is employed is not important to the present invention.

The Jackpot Controller

As individual games are played on gaming devices in the form the gaming machines 120 of FIG. 1, data indicating the contributions of individual games is sent over the network to the jackpot controller 110. In this respect, the jackpot controller operates in the same manner as a conventional jackpot controller. Accordingly it will be appreciate that the individual gaming machines may contribute towards several jackpot pools or contribute towards different jackpot pools.

A contribution processor module 510 processes each contribution received from the gaming devices 120 and updates the jackpot pool data 520 with an amount corresponding to the contribution. The contribution processor 510 also determines the value of a contribution parameter associated with the contribution. The contribution parameter can take a number of forms and can be, for example, the arrival time of the contribution, the number of games played on a gaming device associated with the contribution, turnover on a gaming device associated with the contribution, total win on a gaming device associated with the contribution or any other item derivable either from the data communicated from the gaming device or derivable from its arrival at the jackpot controller 110 as well as combinations thereof. The value is used as a seed value to randomly generate a submission value for use in determining whether to make a jackpot award as described in further detail below.

The value to be used as the seed value is communicated to the award determiner 530. The submission value generator of the award determiner 531 provides the seed value to a random number generator 540, obtains a submission value, and returns the submission value to the submission value generator 531. The submission value generator 531 provides the submission value to comparator 530. Concurrently, a trigger value determiner 533, determines a current value of a jackpot trigger value from the current value of at least one jackpot trigger parameter. The jackpot trigger value parameter is typically a system value associated with a jackpot controller. For example, the current time, the current pool value or the current number of contributions made.

This current value is mapped to a value of a defined set of possible values that the jackpot trigger value is able to take as will be described in further detail below. The submission value generator 531 is also arranged so that the submission value may only take values corresponding to the defined set of values. The trigger value determiner 533 supplies the current value to the comparator 532 which determines whether the values correspond. For example, by determining whether the values match exactly or by determining whether they are within a defined tolerance with one another. If the values correspond, the award determiner 530 determines that an award should be made to the player of the gaming device that made the contribution and makes the award. For example, by sending a jackpot win signal to the gaming device 120. In the embodiment, the number of values in the set of defined values typically corresponds to a desired hit rate of the jackpot.

It will be appreciated that in the embodiment, the jackpot controller 110 is described as having a number of different modules 510,530,540. The jackpot controller can effectively be a specially configure server computer (as is known in the art). Accordingly, modules 510,530,540 can be implemented by a processor of the server executing program code routines stored in a memory, the memory also arranged to sotre data 520,550.

Figure 6:
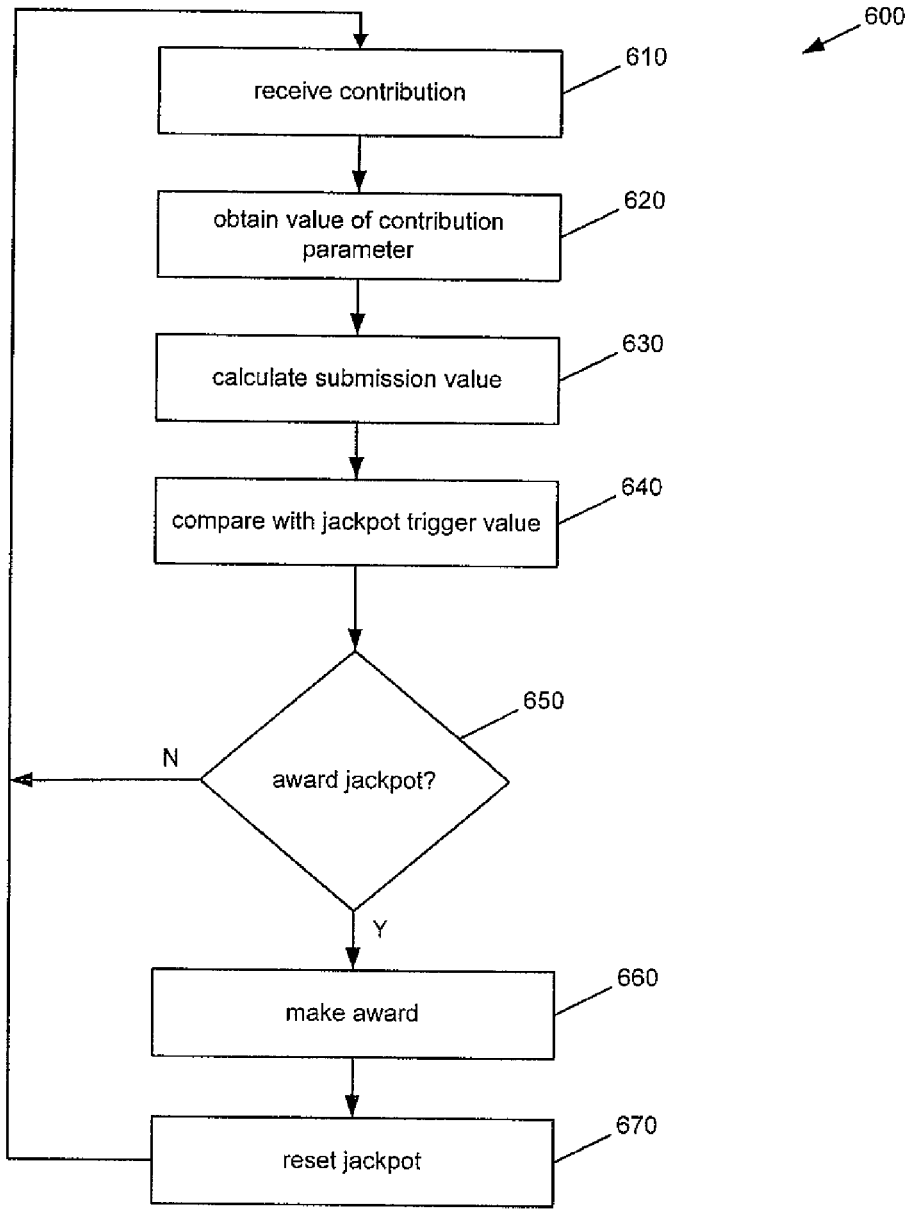
FIG. 6 is a flow chart of an embodiment.

The method 600 is summarised in FIG. 6 and involves receiving 610 a contribution, obtaining 620 the value of the contribution corresponding to the contribution, and calculating 630 a submission value. The submission value is compared 640 to the current value of the jackpot trigger parameter. From the comparison, it is determined 650 whether to award a jackpot. If no jackpot is awarded the next contribution is processed. If a jackpot is to be awarded, the award is made 660 and the jackpot reset 670 before the next contribution is processed.

Further aspects of the method will be apparent from the above description. Persons skilled in the art will also appreciate that the method could be embodied in program code.

The program code could be supplied in a number of ways, for example on a computer readable medium, such as a disc or a memory (for example, that could replace part of memory 103) or as a data signal (for example, by downloading it from a server to the jackpot controller).

Persons skilled in the art will appreciate that in some embodiments, the chance of winning the jackpot should be proportional to the contribution. In such embodiments, more than one submission value may be generated in respect of each contribution (based on its value), for example, by using the same seed value to obtain two different random submission values from the random number generator 540 if the contribution is twice a base contribution amount.

EXAMPLE

In one example, the contribution processor 510 determines the time at which the contribution is received to be the contribution parameter and this is supplied to the award determiner. The jackpot trigger parameter of the system which is used is the current system time of the jackpot controller 500.

The triggering time value is a fractional value, such as the hours of a day, day of the month, day of the year, seconds of the day/hour etc. The fraction corresponds to the desired hit rate. The random number generator 540 is arranged to return values within the corresponding number of fractions. For example, if the desired hit rate is 1 in 100,000 the day can be divided up into sections of 100,000 and the trigger value determiner 533 maps the current time to one of the numbers in the range of 1 to 100,000. Similarly, the submission time of the contribution is used by the submission value generator 531 to generate another value in the range of 1 to 100,000 from which it is determined by the comparator 532 whether there is a match.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art, in Australia or any other country.

The invention claimed is:

1. A jackpot triggering method for use with a gaming system having a jackpot controller and a plurality of gaming devices, each gaming device having a credit input mechanism configured to accept a physical item associated with a monetary value for establishing a credit balance, the credit balance being increasable and decreasable based at least on wagering activity, a payout mechanism configured to cause a payout associated with the credit balance, the method comprising:

establishing a credit balance via a gaming device to provide for a contribution, and decreasing the credit balance;

determining via the jackpot controller a jackpot trigger value from a current value of at least one jackpot trigger parameter;

generating via the jackpot controller a submission value in response to receipt of the contribution associated with a gaming device participating in the jackpot, by using a value of at least one contribution parameter associated with the contribution as a seed value to randomly generate the submission value;

making via a respective payout mechanism a jackpot award if the submission value corresponds to the jackpot trigger value; and selecting via the jackpot controller the value of the at least one contribution parameter from the group including:

arrival time of the contribution;

number of games played on a gaming device associated with the contribution;

turnover on a gaming device associated with the contribution; and total win on a gaming device associated with the contribution.

2. A method as claimed in claim 1, wherein there are a defined set of jackpot trigger values of the jackpot trigger parameter; and wherein said determining the jackpot value comprises mapping the current value to one of the defined set of values; and wherein the submission values may only take values corresponding to the defined set of values.

3. A method as claimed in claim 2, wherein the number of jackpot trigger values in the set of jackpot trigger values corresponds to a desired hit rate of the jackpot.

4. A method as claimed in claim 1, wherein the at least one jackpot trigger parameter is selected from the group including:

current time;

current pool value; and number of contributions made.

5. A method as claimed in claim 1, wherein the jackpot trigger value is determined from at least two parameters.

6. A method as claimed in claim 1, wherein the jackpot trigger parameter is at least one parameter associated with a jackpot controller.

7. A method as claimed in claim 1, wherein the submission value is determined from at least two parameters associated with the contribution.

8. A jackpot controller for use with a plurality of gaming devices, each gaming device having a credit input mechanism configured to accept a physical item associated with a monetary value for establishing a credit balance, the credit balance being increasable and decreasable based at least on wagering activity, to provide for a contribution, and a payout mechanism configured to cause a payout associated with the credit balance, the jackpot controller comprising:

a trigger value determiner configured to determine a jackpot trigger value from a current value of at least jackpot trigger parameter;

a submission value generator configured to generate a submission value in response to receipt of the contribution associated with a gaming device participating in the jackpot, by using a value of at least one contribution parameter associated with the contribution as a seed value to randomly generate the submission value;

a comparator configured to make a jackpot award at a respective payout mechanism of a gaming device if the submission value corresponds to the jackpot trigger value; and a contribution processor configured to select the value of the at least one contribution parameter from the group including:

arrival time of the contribution;

number of games played on a gaming device associated with the contribution;

turnover on a gaming device associated with the contribution; and total win on a gaming device associated with the contribution.

9. A jackpot controller as claimed in claim 8, further comprising a random number generator configured to receive a seed value corresponding to the contribution parameter and generate the submission value.

10. A jackpot controller as claimed in claim 8, wherein there are a defined set of jackpot trigger values of the jackpot trigger parameter; and wherein the jackpot controller is configured to determine the jackpot trigger value by mapping the current value to one of the defined set of jackpot trigger values, and wherein the submission values may only take values corresponding to the defined set of jackpot trigger values.

11. A jackpot controller as claimed in claim 10, wherein the number of jackpot trigger values in the set of jackpot trigger values corresponds to a desired hit rate of the jackpot.

12. A jackpot controller as claimed in claim 8, wherein the at least one jackpot trigger parameter is selected from the group including:

current time;

current pool value; and number of contributions made.

13. A jackpot controller as claimed in claim 8, wherein the trigger value determiner is further configured to determine the jackpot trigger value from at least two jackpot trigger parameters.

14. A jackpot controller as claimed in claim 8, wherein the jackpot trigger parameter is at least one jackpot trigger parameter associated with the jackpot controller.

15. A jackpot controller as claimed in claim 8, wherein the submission value is determined from at least two contribution parameters associated with the contribution.

16. A gaming system comprising:

a plurality of gaming devices which may participate in a jackpot by making jackpot contributions, each gaming device having a credit input mechanism configured to accept a physical item associated with a monetary value for establishing a credit balance, the credit balance being increasable and decreasable based at least on wagering activity, to provide for a contribution, and a payout mechanism configured to cause a payout associated with the credit balance; and a jackpot controller configured to:

determine a jackpot trigger value from a current value of at least a jackpot trigger parameter;

generate a submission value in response to receipt of each contribution from each gaming device participating in the jackpot, by using a value of at least one contribution parameter associated with the contribution as a seed value to randomly generate the submission value;

make a jackpot award at a respective payout mechanism of a gaming device if the submission value corresponds to the jackpot trigger value;

select the value of the at least one contribution parameter from the group including:

arrival time of the contribution;

number of games played on a gaming device associated with the contribution;

turnover on a gaming device associated with the contribution; and total win on a gaming device associated with the contribution.

17. A gaming system as claimed in claim 16, wherein the jackpot controller comprises a random number generator configured to receive a seed value corresponding to the contribution parameter and generate the submission value.

18. A gaming system as claimed in claim 17, wherein the jackpot controller comprises a contribution processor configured to process the contribution to determine the value of the at least one contribution parameter.

19. A gaming system as claimed in claim 18, wherein there are a defined set of jackpot trigger values of the jackpot trigger parameter; and wherein the jackpot controller is configured to determine the jackpot trigger value by mapping the current value to one of the defined set of jackpot trigger values, and wherein the submission values may only take values corresponding to the defined set of values.

20. A gaming system as claimed in claim 19, wherein the number of jackpot trigger values in the set of jackpot trigger values corresponds to a desired hit rate of the jackpot.

21. A gaming system as claimed in claim 16, wherein the at least one jackpot trigger parameter is selected from the group including:

current time;

current pool value; and number of contributions made.

22. A gaming system as claimed in claim 16, wherein the jackpot controller is further configured to determine the jackpot trigger value from at least two parameters.

23. A gaming system as claimed in claim 16, wherein the jackpot trigger parameter is at least one jackpot trigger parameter associated with the jackpot controller.

24. A gaming system as claimed in claim 16, wherein the submission value is determined from at least two parameters associated with the contribution.

* * * * *